US007658474B2

(12) United States Patent
Sugahara

(10) Patent No.: US 7,658,474 B2
(45) Date of Patent: Feb. 9, 2010

(54) LIQUID TRANSPORTING APPARATUS

(75) Inventor: Hiroto Sugahara, Aichi-ken (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 441 days.

(21) Appl. No.: 11/261,067

(22) Filed: Oct. 27, 2005

(65) Prior Publication Data

US 2006/0087536 A1 Apr. 27, 2006

(30) Foreign Application Priority Data

Oct. 27, 2004 (JP) ..... 2004-311736

(51) Int. Cl.
*B41J 2/045* (2006.01)

(52) U.S. Cl. ..... 347/68; 347/72

(58) Field of Classification Search ..... 347/70–72
See application file for complete search history.

(56) References Cited

U.S. PATENT DOCUMENTS

| | | | |
|---|---|---|---|
| 4,516,140 A | 5/1985 | Durkee et al. | |
| 5,637,126 A | 6/1997 | Ema et al. | |
| 2003/0107622 A1 | 6/2003 | Sugahara | |
| 2004/0090499 A1 * | 5/2004 | Ito | 347/68 |
| 2004/0119792 A1 | 6/2004 | Takahashi | |
| 2005/0134144 A1 | 6/2005 | Buhler et al. | |

FOREIGN PATENT DOCUMENTS

| | | |
|---|---|---|
| EP | 0 656 665 | 6/1995 |
| EP | 1 255 307 | 11/2002 |
| JP | 9-104109 | 4/1997 |
| JP | 2000299510 A | * 10/2000 |
| JP | 2003-338382 | 9/2003 |
| JP | 2004-166463 | 6/2004 |

* cited by examiner

*Primary Examiner*—Matthew Luu
*Assistant Examiner*—Lisa M Solomon
(74) *Attorney, Agent, or Firm*—Reed Smith LLP

(57) ABSTRACT

A piezoelectric actuator includes a vibration plate 30 covering pressure chambers 14 and serving also as a common electrode, a piezoelectric layer 31 arranged on the vibration plate 30 on a side opposite to the pressure chambers 14, and individual electrodes 32. The individual electrodes are each arranged on a surface of the piezoelectric layer 31 opposite to the vibration plate 30, in an area overlapping with an edge portion of the pressure chamber as viewed from a direction orthogonal to a plane in which the pressure chambers are arranged, the edge portion being an area other than the central portion of the pressure chamber. The individual electrodes are extended up to an area outside of the pressure chambers, as viewed from the direction orthogonal to the plane. A liquid transporting apparatus including the piezoelectric actuator has an excellent durability and improved drive efficiency.

16 Claims, 9 Drawing Sheets

LIQUID TRANSPORTING APPARATUS

BACKGROUND OF THE INVENTION

1. Field of the Invention

The present invention relates to a liquid transporting apparatus which transports a liquid.

2. Description of the Related Art

Various liquid transporting apparatuses which transport a liquid to a predetermined position by applying pressure to the liquid, and an ink-jet head in which ink is transported to nozzles and discharged from the nozzles on to an object for discharge such as a recording paper are hitherto known. Among the ink-jet heads, an ink-jet head disclosed in U.S. Patent Application Publication No. U.S. 2003/107622 A1 (FIGS. 6 to 8) corresponding to Japanese Patent Application Laid-open Publication No. 2004-166463, includes a channel unit (cavity plate) in which a plurality of pressure chambers which is long in one direction and communicating with the nozzles are formed, and a piezoelectric actuator which applies pressure for causing an ink to be discharged from the nozzles by changing a volume of the pressure chambers.

Moreover, the piezoelectric actuator of this ink-jet head includes a plurality of piezoelectric sheets made of lead zirconate titanate (PZT) and arranged to cover the pressure chambers, and individual electrodes (drive electrodes) and common electrodes which are arranged alternately between the piezoelectric sheets. The individual electrodes and the common electrodes are formed in areas respectively overlapping the pressure chambers as viewed from a direction orthogonal to a plane of the piezoelectric sheets, in the form of a ring around a circumference of each of the pressure chambers. The piezoelectric actuator has a construction capable of performing a so-called ejection at suction timing in which once the piezoelectric actuator increases the volume of the pressure chambers to draw the liquid into the pressure chambers, then the piezoelectric actuator decreases the volume of the pressure chambers to apply a substantial amount of pressure to the liquid.

In other words, when a drive voltage is applied to the individual electrodes while the common electrodes are kept at a ground potential, portions of the piezoelectric sheets having the shape of a ring along the circumference of each of the pressure chambers, which are sandwiched between the individual electrodes and the common electrodes are contracted in a direction parallel to the planes of the piezoelectric sheets. As a result, the plurality of piezoelectric sheets are deformed to project toward a side opposite to one of the pressure chambers, thereby increasing the volume inside the pressure chamber and generating a pressure wave inside the pressure chamber. Further, when the drive voltage applied to the individual electrodes is stopped at a timing when the pressure wave in the pressure chamber changes to positive, the piezoelectric sheets are restored to the original shape, thereby reducing the volume inside the pressure chamber. However, at this time, the pressure wave generated with the increase in the volume of the pressure chamber and the pressure wave generated with the restoration of the piezoelectric sheet are combined and a substantial pressure is applied to the ink. Therefore, the piezoelectric actuator of this ink-jet head is capable of applying a substantial pressure to the ink with a comparatively low drive voltage. Accordingly, a drive efficiency of the piezoelectric actuator is improved. Moreover, the actuator is structured such that an electric field is made to act on a piezoelectric layer by applying the drive voltage to the individual electrodes only at a timing of ink discharge, and the electric field is not applied to the piezoelectric layer at timing other than the timing of ink-discharge. Therefore, polarization deterioration hardly occurs in the piezoelectric layer, and accordingly the durability of the actuator is improved.

SUMMARY OF THE INVENTION

As mentioned above, in the ink-jet head of the U.S. Patent Application Publication No. U.S. 2003/107622 A1, individual electrodes and common electrodes are formed in the form of a ring along a circumference of each of pressure chambers in areas respectively overlapping with pressure chambers in a plan view. However, according to the study and research conducted by the inventors, after the publication of the abovementioned patent document, the following fact was discovered by the inventors. Namely, since these electrodes are formed only in the areas overlapping the pressure chambers, the piezoelectric layer is hardly deformed in an area proximal to an inner side of the circumference of one of the pressure chambers, the area being near to an area outside of the pressure chamber in which a deformation of the vibration plate is constrained, and due to this, an amount of deformation of the vibration plate at a position overlapping with the central portion of the pressure chamber is reduced. Therefore, to improve the drive efficiency of the actuator by increasing the amount of deformation of the vibration plate, it was desirable to deform substantially the piezoelectric layer in the area proximal to the inner side of the circumference of the pressure chamber, and further improvement in this point was demanded.

An object of the present invention is to provide a liquid transporting apparatus which includes a piezoelectric actuator having an excellent durability and improved drive efficiency.

According to the present invention, there is provided a liquid transporting apparatus comprising a channel unit having a plurality of pressure chambers arranged along a plane, and a piezoelectric actuator which applies pressure to a liquid in the pressure chambers by changing a volume of the pressure chambers; wherein the piezoelectric actuator includes: a vibration plate which covers the pressure chambers, a piezoelectric layer which is arranged on a side of the vibration plate opposite to the pressure chambers, a plurality of individual electrodes each of which is arranged in an area of one surface of the piezoelectric layer, the area overlapping with an edge portion of each of the pressure chambers as viewed from a direction orthogonal to the plane, the edge portion being an area other than a central portion of each of the pressure chambers, and a common electrode which is arranged on the other surface of the piezoelectric layer; and wherein each of the individual electrodes is extended up to an area outside of one of the pressure chambers, as viewed from the direction orthogonal to the plane.

In this liquid transporting apparatus, each of the individual electrodes of the piezoelectric actuator is arranged in the area overlapping the edge portion of one of the pressure chambers. Therefore, when a drive voltage is applied to the individual electrode, a portion of the piezoelectric layer along an edge of the pressure chamber, which is sandwiched between the individual electrode and the common electrode, is contracted in a direction parallel to a plane of the piezoelectric layer. As a result, the vibration plate is deformed so as to project toward a direction opposite to the pressure chamber, with a portion overlapping the central portion of the pressure chamber as the apex of the deformation. Due to this, the volume of the pressure chamber is increased and a pressure wave is generated inside the pressure chamber. Further, when the drive voltage applied to the individual electrode is stopped at a timing when the pressure wave in the pressure chamber changes to positive, the vibration plate is restored to the original shape, thereby reducing the volume inside the pressure chamber. However, at this time, the pressure wave generated with the increase in the volume of the pressure chamber and the pressure wave generated with the restoration of the vibration plate are combined and a substantial pressure is applied to a liquid in the pressure chamber. Therefore, it is possible to apply high pressure to the liquid with a comparatively low drive voltage, and thus a drive efficiency of the piezoelectric actuator is increased. Moreover, since an electric field acts on the piezoelectric layer when the drive voltage is applied to the individual electrodes only at a timing of transporting the liquid, polarization deterioration hardly occurs in the piezoelectric layer, and accordingly the durability of the actuator is improved.

Furthermore, each of the individual electrodes is extended from the edge portion of one of the pressure chambers to the area outside of the pressure chamber. Therefore, when the drive voltage is applied to the individual electrode, the piezoelectric layer is contracted even in the area outside of the pressure chamber, in the direction parallel to the plane. For this reason, the piezoelectric layer in the area which continues into the area outside of the pressure chamber and which overlaps with the area proximal to the inner side of the edge of one of the pressure chambers is easily deformed, and the amount of deformation of the vibration plate is increased. Thus, only by forming each of the individual electrodes to extend to the area outside of one of the pressure chambers, the vibration plate can be deformed more substantially and the drive efficiency of the actuator can be improved with little increase in the manufacturing cost.

In the liquid transporting apparatus of the present invention, the channel unit has, in a surface joined to the vibration plate, the plurality of pressure chambers having openings on a side of the vibration plate and column portions which are positioned between the pressure chambers, define the respective openings and support the vibration plate, and a portion of each of the individual electrodes which is extended up to the area outside of one of the pressure chambers may overlap with the column portions as viewed from the direction orthogonal to the plane. Thus, because each of the individual electrodes is extended up to the area overlapping with the column portions, when the drive voltage is applied to the individual electrode, the piezoelectric layer is contracted in the direction parallel to the plane even in the column portions where the deformation of the vibration plate is constrained, and a portion of the piezoelectric layer in the area proximal to the inner side of to the edge of the pressure chambers is deformed easily. Therefore, the amount of deformation of the vibration plate is increased and the drive efficiency of the piezoelectric actuator is improved.

In the liquid transporting apparatus of the present invention, one of the individual electrodes, as viewed from the direction orthogonal to the plane, may be extended up to a substantially intermediate position between a pressure chamber included in the pressure chambers and corresponding to the individual electrode and other pressure chamber adjacent to the pressure chamber corresponding to the individual electrode. The individual electrode is maximally extended in the area outside of the pressure chamber in a range not overlapping with another individual electrode corresponding to an adjacent pressure chamber. Therefore, the portion of the piezoelectric layer in the area proximal to the inner side of the edge of the pressure chamber is easily deformed, and the vibration plate can be deformed further substantially.

In the liquid transporting apparatus of the present invention, furthermore, the vibration plate may be formed of a metallic material and may function also as the common electrode. In this case, it is not necessary to provide a common electrode separate from the vibration plate. Or, the vibration plate may be insulative at least on a surface thereof on the side opposite to the pressure chambers, and the common electrode may be provided on the surface of the vibration plate on the side opposite to the pressure chambers. Or, the vibration plate may be insulative at least on a surface thereof on the side opposite to the pressure chambers, and the individual electrodes may be provided on the surface of the vibration plate on the side opposite to the pressure chambers.

Furthermore, in the liquid transporting apparatus of the present invention, the piezoelectric layer may be formed to cover entirely the plurality of pressure chambers. Or, the piezoelectric layer, as viewed from the direction orthogonal to the plate, may be formed in an area other than the area overlapping with the central portion of each of the pressure chambers.

In the liquid transporting apparatus of the present invention, a length of each of the individual electrodes in the area outside of one of the pressure chambers may be not less than a thickness of the piezoelectric layer. By adjusting the length of each of the individual electrodes (length of an extended portion) in the area outside of one of the pressure chambers, the piezoelectric layer can be easily deformed assuredly by overcoming the stiffness of the piezoelectric layer.

Each of the individual electrodes, as viewed from the direction orthogonal to the plane, may be extended up to the area outside of one of the pressure chambers in a direction intersecting a longitudinal direction of one of the pressure chambers. Normally, the piezoelectric layer and the vibration plate are deformed substantially in the direction intersecting the longitudinal direction of the pressure chambers. Accordingly, to further increase the amount of deformation in such a direction, an extended portion of the individual electrode in the direction may be secured. Moreover, a portion of each of the individual electrodes which is extended up to the area outside of one the pressure chambers may be formed symmetrically with respect to a central axis of one of the pressure chambers, the central axis being parallel to the longitudinal direction of one of the pressure chambers. The direction intersecting the longitudinal direction of the pressure chamber is not only the direction orthogonal to the longitudinal direction of the pressure chamber but also includes a direction intersecting at an angle or intersecting obliquely the longitudinal direction. For example, when each of the pressure chambers is elliptical in shape, each of the individual electrodes, as viewed from the direction orthogonal to the plane, may be extended up to the area outside of one of the pressure chambers only in a short axis direction of the ellipse or in both the short axis direction and a long axis direction of the ellipse.

DETAILED DESCRIPTION OF THE PREFERRED EMBODIMENTS

Embodiment of the present invention will be described below. This embodiment is an example in which the present invention is applied to an ink-jet head which discharges ink from nozzles.

Figure 1:
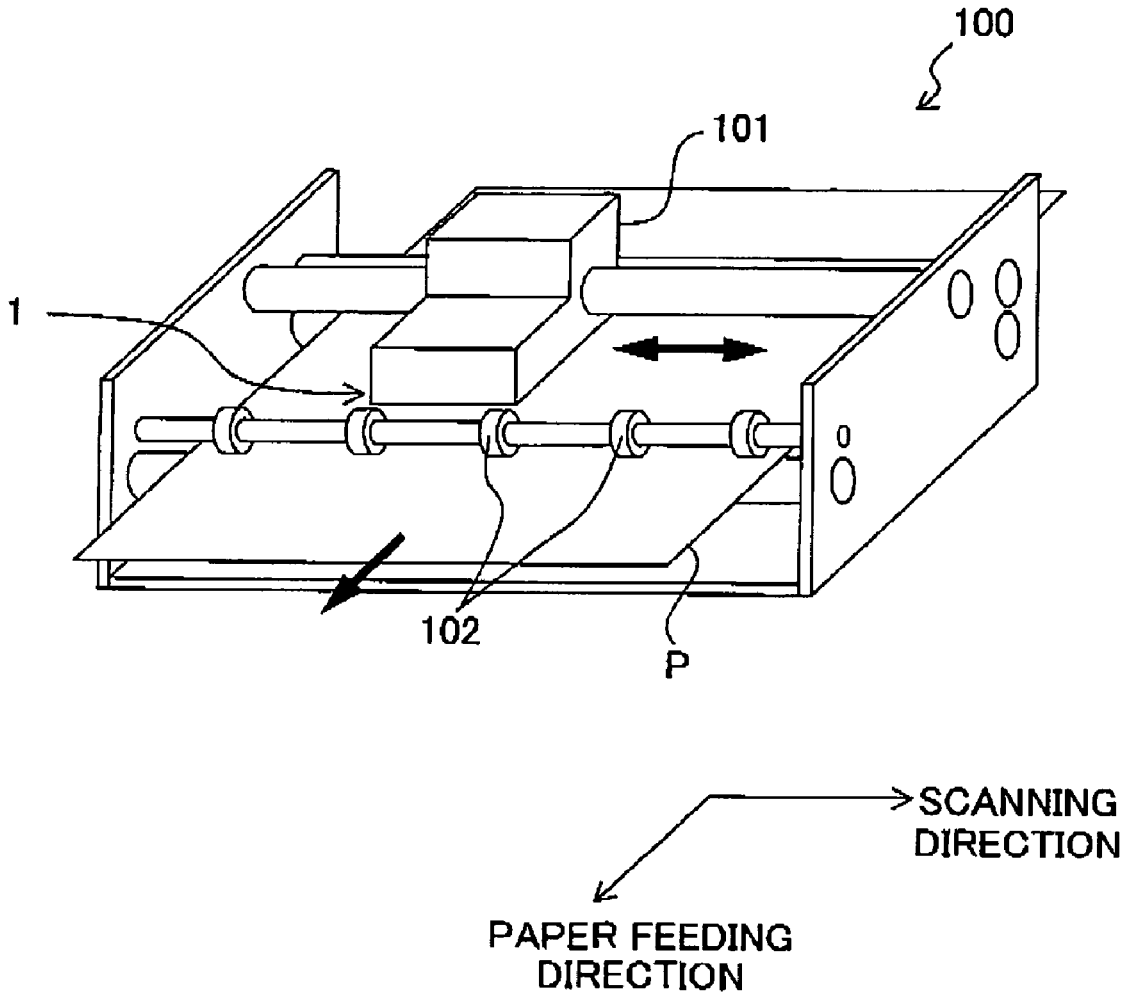
FIG. 1 is a schematic perspective view of an ink-jet printer according to an embodiment of the present invention.

First of all, an ink-jet printer 100 which includes an ink-jet head 1 will be described briefly. As shown in FIG. 1, the ink-jet printer 100 includes a carriage 101 which is movable in a left and right direction in FIG. 1 (direction indicated by two pointed arrows), an ink-jet head 1 (liquid transporting apparatus) of serial type which is provided on the carriage 101 and discharges ink onto a recording paper P, and transporting rollers 102 which carry the recording paper P in a forward direction (direction indicated by a horizontal arrow) in FIG. 1. The ink-jet head 1 moves integrally with the carriage 101 in a left and right direction (scanning direction) and discharges ink onto the recording paper P from ejecting ports of nozzles 20 (refer to FIG. 2 to FIG. 5) formed in an ink-discharge surface of a lower surface of the ink-jet head 1. The recording paper P with an image recorded thereon by the ink-jet head 1 is discharged forward (paper feeding direction) by the transporting rollers 102.

Next, the ink-jet head 1 will be described. As shown in FIG. 2 to FIG. 5, the ink-jet head 1 includes a channel unit 2 in which an ink channel is formed, and a piezoelectric actuator 3 which is arranged on a surface of the channel unit 2.

To start with, the channel unit 2 will be described below. The channel unit 2 includes a cavity plate 10, a base plate 11, a manifold plate 12, and a nozzle plate 13, and these four plates 10 to 13 are joined in stacked layers. Among these four plates, the cavity plate 10, the base plate 11, and the manifold plate 12 are substantially rectangular stainless steel plates. Therefore, an ink channel of a pressure chamber 14 and a manifold 17 which will be described later can be formed easily by etching in these plates. Moreover, the nozzle plate 13 is formed of a high-molecular synthetic resin material such as polyimide and is joined to a lower surface of the manifold plate 12. Or the nozzle plate 13 may also be formed of a metallic material such as stainless steel similar to the three plates 10 to 12.

Figure 2:
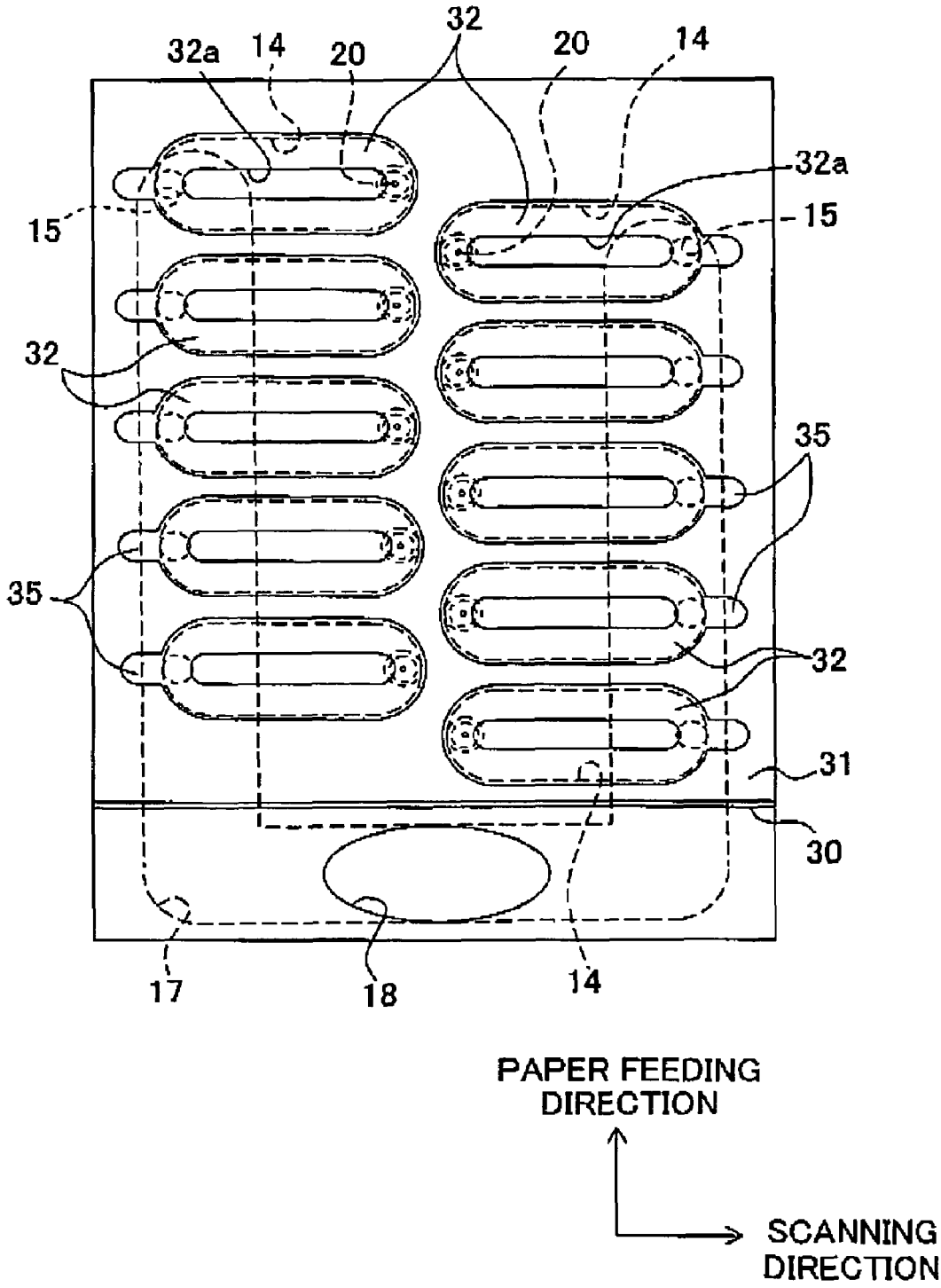
FIG. 2 is a plan view of an ink-jet head.
Figure 3:
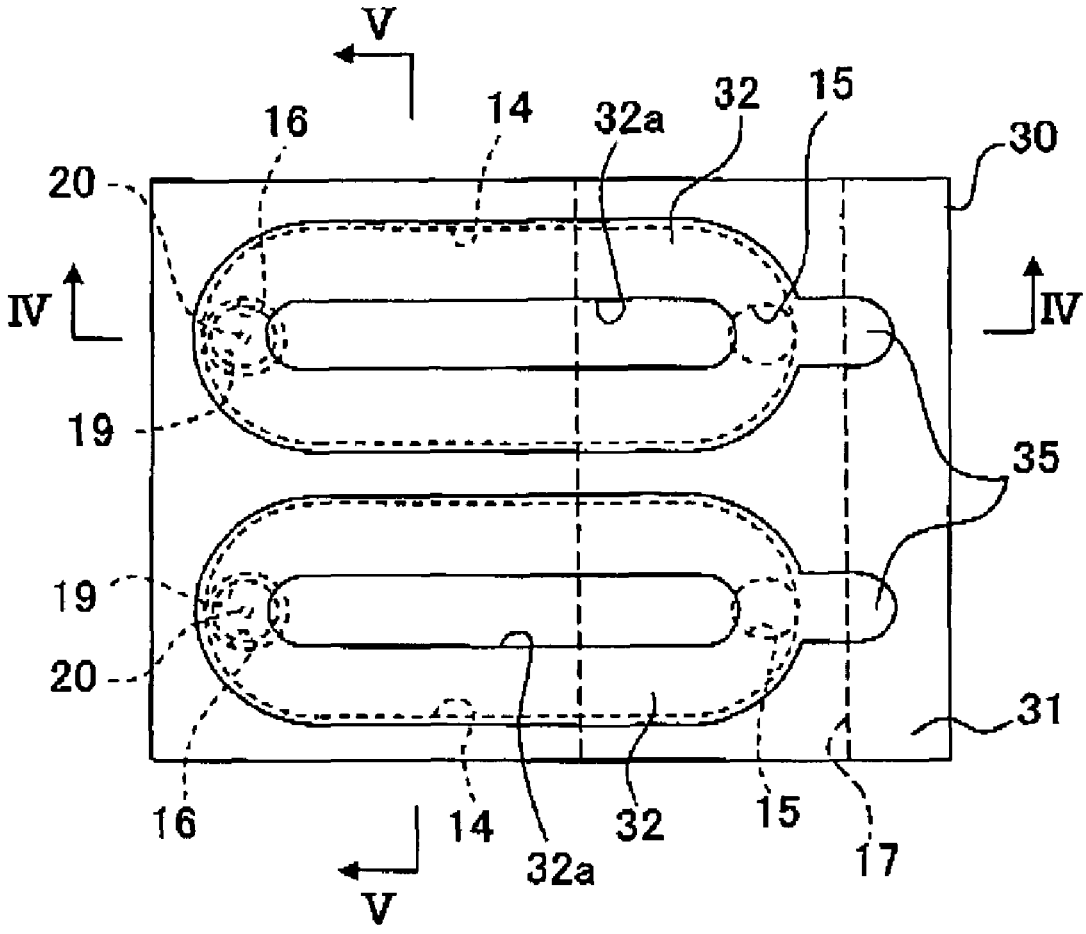
FIG. 3 is a partially enlarged view of FIG. 2.

As shown in FIG. 2 and FIG. 3, in the cavity plate 10, a plurality of pressure chambers 14 is formed. These pressure chambers 14 open upward and are covered by a vibration plate 30 which is joined to an upper surface of the cavity plate 10 and will be described later. Each of the pressure chambers 14, in a plan view, i.e. as viewed from a direction orthogonal to a plane in which the pressure chambers 14 are formed, is substantially elliptical in a plan view and is arranged such that a long axis of the elliptical pressure chamber is parallel to a scanning direction (horizontal direction in FIG. 2).

Communicating holes 15 and 16 are formed in the base plate 11 respectively at positions which overlap in a plan view with both end portions of the associated pressure chamber 14 in the longitudinal direction. Moreover, in the manifold plate 12, a manifold 17 is formed. The manifold 17 has portions extending in two rows in the paper feeding direction (vertical direction in FIG. 2) and overlaps with a portion of each of the pressure chambers 14 on a side of the communicating hole 15 (a portion on a right side or a left side of each of the pressure chambers 14 in FIG. 2) in a plan view. Ink is supplied to the manifold 17 from an ink tank (omitted in the diagram) via an ink-supply port 18 formed in the cavity plate 10. Moreover, a communicating hole 19 which communicates with the communicating hole 16, is formed at a position which overlaps in a plane view with the end portion of the each of the pressure chambers on a side opposite to the manifold 17 (for example, a portion on the left side of each of the pressure chambers 14 in FIG. 3). Furthermore, as appreciated from FIG. 3, a plurality of nozzles 20 is formed in the nozzle plate 13 at positions which respectively overlap in a plan view with the left edge portion of the pressure chambers 14. The nozzles 20 are formed for example, by means of an excimer laser process on a substrate of a high-molecular synthetic resin such as polyimide.

Figure 4:
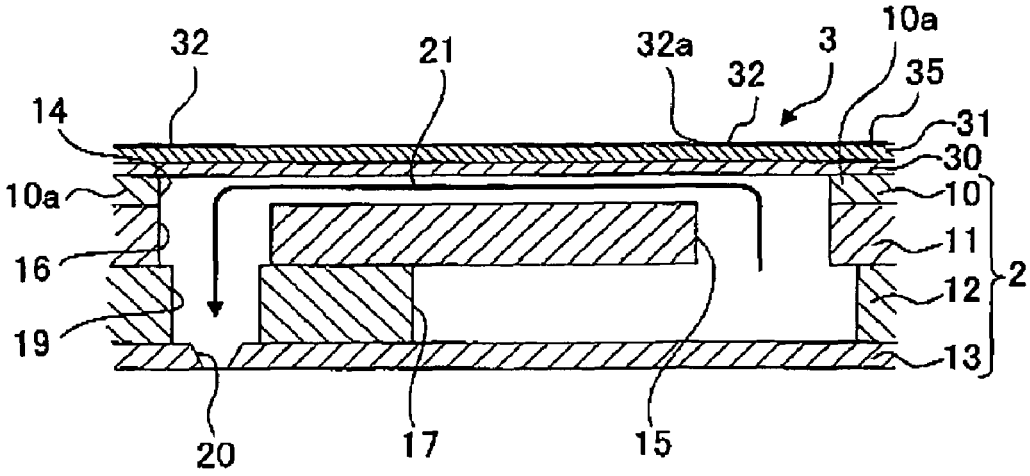
FIG. 4 is a cross-sectional view taken along a line IV-IV of FIG. 3.
Figure 5:
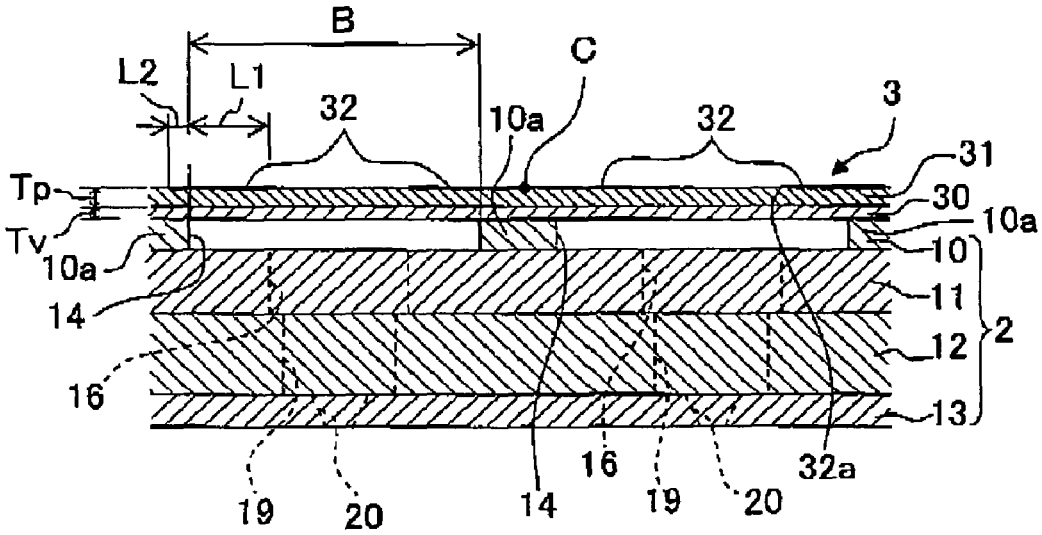
FIG. 5 is a cross-sectional view taken along a line V-V of FIG. 4.

As shown in FIG. 4, the manifold 17 communicates with the pressure chamber 14 via the communicating hole 15, and the pressure chamber 14 communicates with the nozzle 20 via the communicating holes 16 and 19. Thus, an individual ink channel 21 from the manifold 17 to the pressure chamber 14 is formed in the channel unit 2.

Next, the piezoelectric actuator 3 will be described below. As shown in FIG. 2 to FIG. 5, the piezoelectric actuator 3 includes the vibration plate 30, the piezoelectric layer 31, and a plurality of individual electrodes 32. The vibration plate 30 which is electroconductive is arranged on an upper surface of the channel unit 2. The piezoelectric layer 31 is formed on an upper surface of the vibration plate 30 (a surface on a side opposite to the pressure chamber 14). The individual electrodes 32 are formed on an upper surface of the piezoelectric layer 31 corresponding to the respective pressure chambers 14. The piezoelectric layer 31 is polarized, at least in an area where the upper surface of the piezoelectric layer is covered by the individual electrodes 32, in a direction of the thickness of the piezoelectric layer from the individual electrodes 32 to the vibration plate 30.

The vibration plate 30 is a plate having substantially rectangular shape in a plan view and is made of a metallic material (such as an iron alloy like stainless steel, a nickel alloy, an aluminum alloy, or a titanium alloy). The vibration plate 30 is joined to the cavity plate 10 such that the vibration plate 30 covers the pressure chambers 14. Moreover, the vibration plate 30 positioned facing the plurality of individual electrodes 32 also serves as a common electrode which generates an electric field in the piezoelectric layer 31 between the individual electrodes 32 and the vibration plate 30.

The piezoelectric layer 31, which is composed of lead zirconate titanate (PZT) which is a solid solution of lead titanate and lead zirconate and is a ferroelectric substance, is formed on the upper surface of the vibration plate 30 so as to entirely cover the pressure chambers 14. The piezoelectric layer 31 can be formed for example, by an aerosol deposition method (AD method) in which particles of a piezoelectric material are discharged and deposited on a surface on which the layer is to be formed. Moreover, the piezoelectric layer 31 can also be formed by a known method such as a sputtering method, a CVD (chemical vapor deposition) method, a sol-gel method, and a hydrothermal synthesis method. Or, the piezoelectric layer 31 may be formed by cutting, to a predetermined size, a piezoelectric sheet made by baking a green sheet of PZT and fixing the cut piezoelectric sheet to the vibration plate 30.

The individual electrode 32 has a shape of an elliptical ring which is long in the scanning direction (horizontal direction in FIG. 2) with a hole 32*a* formed in a central portion thereof. Furthermore, the individual electrode 32 is formed at a position surrounding a central portion of each of the pressure chambers 14 in an area overlapping in a plan view with an edge portion of the pressure chamber, the edge portion being other than the central portion of the pressure chamber 14. The individual electrode 32 is made of an electroconductive material (such as gold, copper, silver, palladium, platinum, or titanium). Moreover, the individual electrode 32 is extended, in a plan view, up to an area outside of the pressure chamber 14 throughout the circumference of the individual electrode 32. A portion of the individual electrode 32 which is extended up to the outside of the pressure chamber overlaps with columns (column portions) 10*a* which are positioned between the pressure chambers 14 formed in the cavity plate 10, and support the vibration plate 30. Furthermore, from a right end portion (for example, in FIG. 3) of each of the individual electrodes 32, a terminal 35 is extended in the scanning direction. A driver IC (omitted in the diagram) is connected to these terminals 35 via a flexible wire member (omitted in the diagram) such as a flexible printed circuit (FPC). A drive voltage is applied selectively to the individual electrodes 32 from the driver IC via the terminals 35. The individual electrodes 32 and the terminals 35 can be formed by a method such as screen printing, sputtering method, or a vapor deposition method.

Next, the piezoelectric actuator 3 during the ink discharge will be described below. When the drive voltage is applied selectively to the individual electrodes 32 from the driver IC, an electric potential of an individual electrode 32 on an upper side of the piezoelectric layer 31, to which the drive voltage is applied, and an electric potential of the vibration plate 30 which functions as a common electrode on a lower side of the piezoelectric layer 31 and which is kept at a ground potential are made to be different, and an electric field is generated in a vertical direction in a portion of the piezoelectric layer 31 sandwiched between the individual electrode 32 and the vibration plate 30. Accordingly, a portion of the piezoelectric layer 32 directly below the individual electrode 32 to which the drive voltage is applied is extended in a direction of thickness which is a direction of polarization, and is contracted in a direction parallel to a plane orthogonal to the direction of polarization.

Figure 6:
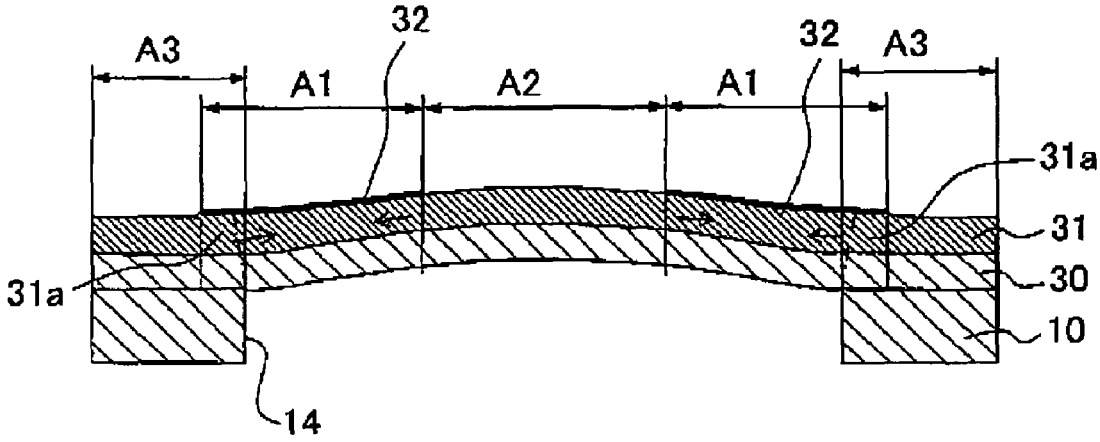
FIG. 6 is diagram showing a deformed state of a vibration plate in a piezoelectric actuator of the embodiment.

Here, as mentioned earlier, the individual electrode 32 is formed in the area overlapping in a plan view with the edge portion of the pressure chamber 14 of the piezoelectric layer 31. Accordingly, as shown in FIG. 6, an area of the piezoelectric actuator 3 overlapping with the edge of the pressure chamber 14 becomes a driving zone A1 in which the piezoelectric layer 31 deforms by itself, and an area overlapping with a central portion of the pressure chamber 14 becomes a driven zone A2 which is deformed along with the deformation of the piezoelectric layer 31 in the driving zone A1. Moreover, an area outside of the pressure chamber 14, in which the vibration plate 30 is joined to the cavity plate 10, becomes a constrained zone A3 in which the deformation of the vibration plate 30 is constrained. The piezoelectric layer 31 in the driving zone A1 on both sides in FIG. 6 is contracted in a direction parallel to the plane, whereas the vibration plate 30 in the driving zone A1 is not contracted in the direction parallel to the plane. Due to this, the vibration plate 30 and the piezoelectric layer 31 of the driven zone A2 sandwiched between (intervening in) the driving zones A1 are deformed. The vibration plate 30 is deformed so as to project toward a side opposite to the pressure chamber 14 with the center of the driven zone A2 as an apex. As the vibration plate 30 is deformed, a volume inside the pressure chamber 14 increases and a pressure wave 14 is generated in the pressure chamber 14.

Here, as it is hitherto known, when a time taken by the pressure wave generated due to the increase in the volume of the pressure chamber 14 for one way propagation in the longitudinal direction is elapsed, the pressure in the pressure chamber 14 is changed to a positive pressure. At this point, at the timing of the change of pressure in the pressure chamber to positive pressure, the driver IC stops applying the drive voltage to the individual electrodes 32. As the driving electrode IC stops applying the pressure, the electric potential of the individual electrodes 32 comes to ground potential and the vibration plate 30 restores to the original shape and the volume inside the pressure chamber 14 decreases. At this time, the pressure wave generated with the increase in the volume of the pressure chamber 14 mentioned earlier and the pressure wave generated with the restoration of the vibration plate 30, are combined. Due to combining of the two waves, a substantial pressure is applied to the ink in the pressure chamber 14 and the ink is discharged from the nozzle 20. Therefore, it is possible to apply a high pressure to the ink with a low drive voltage, and accordingly a drive efficiency of the piezoelectric actuator 3 is improved. Moreover, since the electric field is made to act on the piezoelectric layer 31 by applying the drive voltage to the individual electrodes 32 only at a timing of ink discharge, the polarization deterioration hardly occurs in the piezoelectric layer 31, and accordingly the durability of the actuator is improved.

Figure 7:
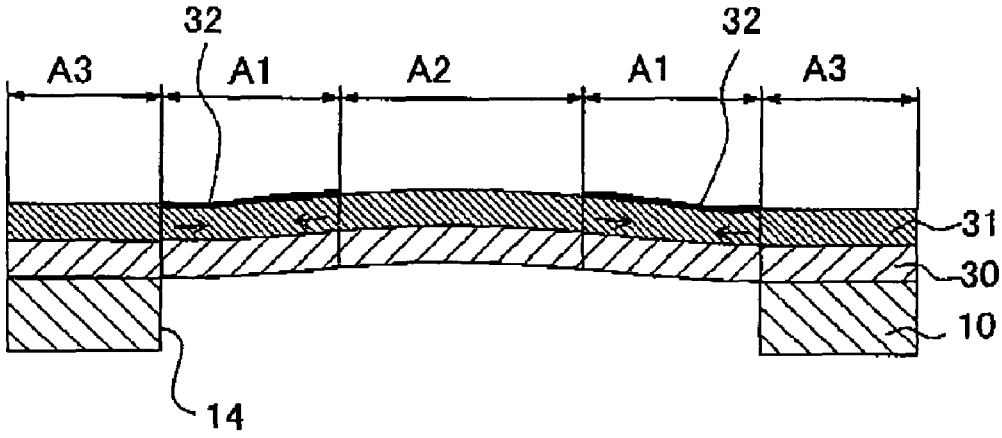
FIG. 7 is a diagram showing a deformed state of a vibration plate in a conventional piezoelectric actuator.

Furthermore, in the piezoelectric actuator 3 according to this embodiment, as shown in FIG. 2 to FIG. 5, the individual electrode 32 is extended, in a plan view, up to the area outside of the pressure chamber 14 throughout the circumference of the individual electrode 32, and the portion of the individual electrode 32 which is extended up to the outside of the pressure chamber 14 overlaps with the column portions 10*a* which are positioned between the pressure chambers 14 formed in the cavity plate 10 and support the vibration plate 30. Therefore, this means that, as shown in FIG. 6, the drive zone A1 is extended up to the constrained zone A3 in which the deformation of the vibration plate 30 is constrained, and overlaps with the constrained zone A3, and a portion 31*a* of the piezoelectric layer 31, which is positioned in the area outside of the pressure chamber 14 is also contracted in a direction parallel to the plane. Therefore, as shown in FIG. 7, as compared to a case in which the individual electrode 32 is deformed only in the area overlapping with the pressure chamber 14 (for example, see U.S. Patent Application Publication No. U.S. 2003/107622 A1 mentioned earlier), the deformation of the vibration plate 30 on an inner side proximal to the edge of the pressure chamber 14 in the drive zone A1 increases, and along with the increase in the deformation of the vibration plate 30 in the driving zone A1, an amount of deformation of the vibration plate 30 in the driven area A2 is also increased In other words, only by forming the individual electrodes 32 up to the area outside of the pressure chamber 14, the vibration plate 30 can be deformed substantially by the same drive voltage, and the drive efficiency of the piezoelectric actuator 3 can be improved with little increase in the cost.

As the thickness of the piezoelectric layer increases, a force required for deforming the piezoelectric layer also increases. Therefore, it is difficult to absolutely determine the length of each of the individual electrodes 32 in the area outside of the pressure chamber 14 (length of the extended portion). However, it is desirable that the length is at least not less than the thickness of the piezoelectric layer 31. Moreover, as the thickness of the vibration plate 30 increases, a force required for deforming the vibration plate 30 also increases. Therefore, when the vibration plate 30 is thicker than the piezoelectric layer 31, it is desirable that the length of the extended portion of the individual electrode 32 is not less than the thickness of the vibration plate 30. Particularly, it is desirable that the length of the extended portion of the individual electrode 32 is not less than a sum of the thickness of the piezoelectric layer 31 and the thickness of the vibration plate 30. From a view point of increasing the amount of deformation of the vibration plate 30 as much as possible, it is desirable that the individual electrode 32 is extended as wide (long) as possible toward the outside of the pressure chamber 14 to an extent that the individual electrode 32 does not overlap with an adjacent individual electrode 32. Therefore, in the column portion 10*a*, it is particularly desirable that the individual electrode 32 is extended approximately up to an intermediate position between the pressure chamber 14 corresponding to this individual electrode 32 and a pressure chamber 14 adjacent to the pressure chamber 14, in a plan view (position of point C in FIG. 5).

As shown in FIG. 2, sometimes the individual electrode 32 is extended up to the outside of the pressure chamber 14 in the scanning direction, thereby forming a terminal 35. Such an individual electrode 32 extended up to the outside of the pressure chamber 14 only for the purpose of forming a wire section is not to be included in "the individual electrodes 32 each of which is extended up to the area outside of one of the pressure chambers 14 as viewed from the direction orthogonal to the plane" as described in the present invention. This is because, even though such an individual electrode extends up to the area outside of the pressure chamber 14 only for the purpose of forming such wire section, the individual electrode is incapable of substantially increasing the amount of deformation of the vibration plate 30.

Here, in order to verify that the amount of deformation of the vibration plate increases in a case where the individual electrode 32 is extended up to the area outside of the pressure chamber 14, as compared to a case where the individual electrode 32 is not extended up to the area outside of the pressure chamber 14, a structure analysis was carried out by a finite element method (FEM). Here, dimensions shown in FIG. 5, a length B of the pressure chamber 14 along a transverse direction (width direction) thereof was made to be 419 μm, thickness Tv of the vibration plate 30 made of stainless steel was made to be 20 μm, thickness Tp of the piezoelectric layer 31 formed of PZT was made to be 10 μm, and the drive voltage applied to the individual electrodes 32 was made to be 20 V. Next, the analysis was carried out for four analysis models which are mutually different in the combination of a value of length L2 of the individual electrode 32 in the area outside of the pressure chamber 14 and a value of length L1 of the individual electrode 32, in the transverse direction (width direction) of the pressure chamber 14, in the area overlapping with the pressure chamber 14. The result of the analysis is shown in Table 1.

TABLE 1

| | L1 (μm) | L2 (μm) | Maximum displacement amount (nm) |
|---|---|---|---|
| Model 1 | 92 | 0 | 99 |
| Model 2 | 92 | 30 | 129 |
| Model 3 | 122 | 0 | 96 |
| Model 4 | 122 | 30 | 127 |

From Table 1, it is appreciated that in models (model 2 and model 4) in which the individual electrode 32 is extended up to the area outside of the pressure chamber 14, the maximum displacement amount (amount of displacement at a position facing the center of an area of the pressure chamber 14) of the vibration plate 30 are respectively about 1.3 times greater than in models of L2=0 (model 1 and model 3) in which the length L1 of the individual electrode 32 in an area overlapping with the pressure chamber 14 is the same in that of models 2 and 4 but the individual electrode 32 is formed only on the inner side of the pressure chamber 14. Accordingly, it is appreciated that in a case in which the individual electrode 32 is formed up to the area outside of the pressure chamber 14, the amount of deformation of the vibration plate 30 is increased as compared with a case in which the individual electrode 32 is not extended up to the area outside of the pressure chamber 14. In addition, as appreciated from Table 1, the length L2=30 μm in the area outside of the pressure chamber is equal to a sum of the thickness Tp of the piezoelectric layer and the thickness Tv of the vibration plate.

Next, modified embodiments in which various modifications are made in the embodiment will be described below. Same reference numerals are used for components having the same structure as in the embodiment described above and the description of these components is omitted.

First Modified Embodiment

Figure 8:
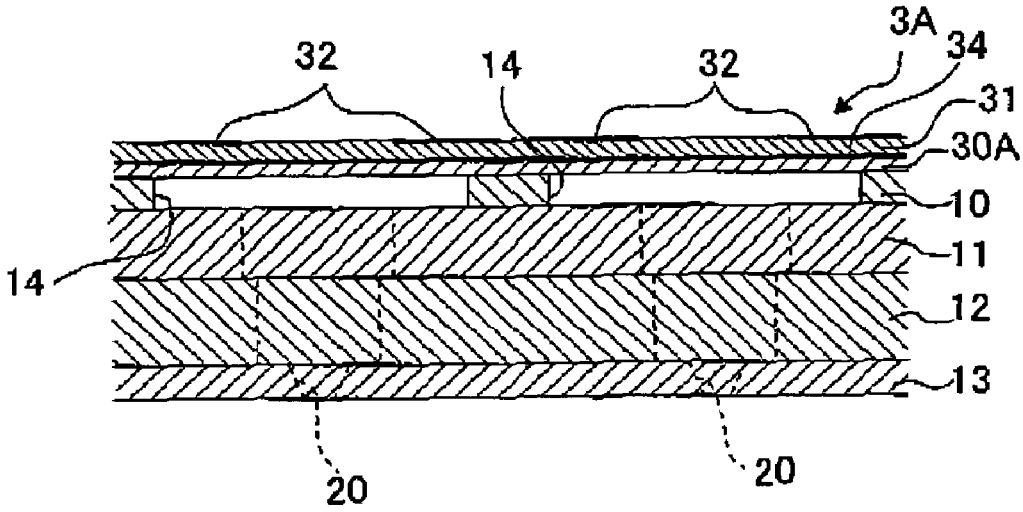
FIG. 8 is a cross-sectional view of a first modified embodiment corresponding to FIG. 5.

The vibration plate may be formed of an insulating material (for example, a silicon material having an oxidized surface, a ceramics material such as P2T, alumina, and zirconium, or a synthetic resin material such as polyimide). In this case, however, as shown in FIG. 8, it is necessary to provide, in a piezoelectric actuator 3A, a common electrode 34 facing the individual electrode 32 for applying an electric field on the piezoelectric layer 31 between the individual electrode 32 and the common electrode 34. As shown in FIG. 8, the common electrode is provided on a surface of an insulating vibration plate 30A opposite to the pressure chamber 14.

Second Modified Embodiment

Figure 9:
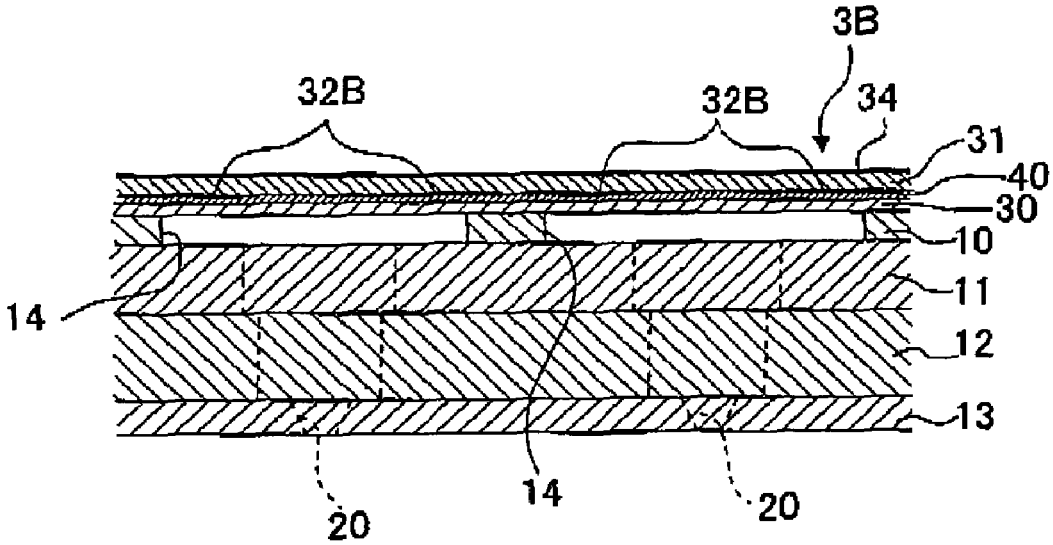
FIG. 9 is a cross-sectional view of a second modified embodiment corresponding to FIG. 5.

In the above-described embodiment, the individual electrodes 32 are formed on the side of the piezoelectric layer 31 opposite to the vibration plate 30. The individual electrodes 32 may be arranged on a side of the piezoelectric layer 31 facing the vibration plate 30, and a common electrode may be arranged on the side of the piezoelectric layer 31 opposite to the vibration plate 30. However, when the vibration plate 30 is made of a metallic material, as shown in FIG. 9, in a piezoelectric actuator 3B, it is necessary to insulate a surface of the vibration plate 30 on which individual electrodes 32B are arranged, by forming an insulating-material layer 40 on an upper surface (a surface on a side opposite to the pressure chamber 14) of the metallic vibration plate 30. The insulating-material layer 40 can be formed of a ceramics material such as alumina, zirconia by a method such as AD (aerosol deposition) method, sputtering method, CVD (chemical vapor deposition) method, or sol-gel method.

Third Modified Embodiment

Figure 10:
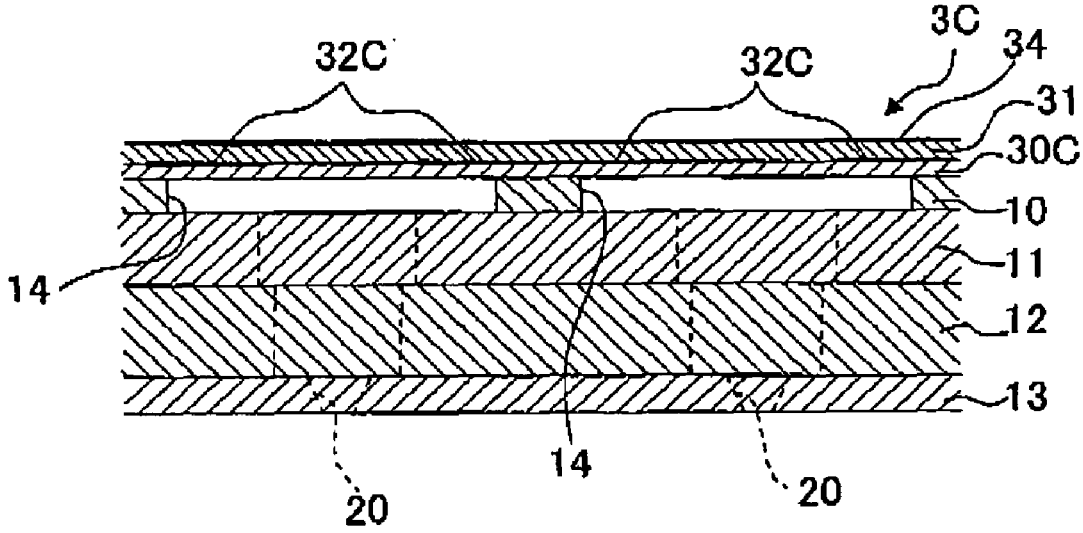
FIG. 10 is a cross-sectional view of a third modified embodiment corresponding to FIG. 5.

When the vibration plate is formed of an insulating material such as a silicon material, a ceramics material, or a synthetic resin material, as shown in FIG. 10, in a piezoelectric actuator 3C, a plurality of individual electrodes 32C may be arranged directly on a vibration plate 30C and the individual electrodes 32C are insulated by the insulating vibration plate 30C.

Fourth Modified Embodiment

Figure 11:
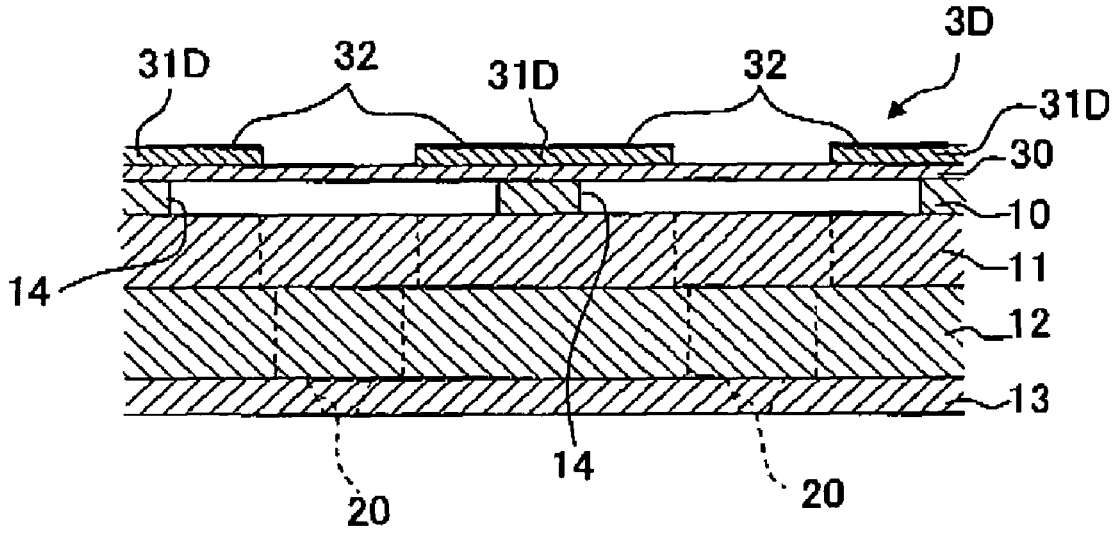
FIG. 11 is a cross-sectional view of a fourth modified embodiment corresponding to FIG. 5.

As shown in FIG. 11, in a piezoelectric actuator 3D, a piezoelectric layer 31D, in a plan view, may not be formed in an area overlapping with a central portion of each of the pressure chambers 14, and may be formed in an area other than the area overlapping with the central portion of each of the pressure chambers 14. In this case, since a driven area overlapping with the central portion of each of the pressure chambers 14 is constructed only of the vibration plate 30, a stiffness of the driven area is reduced, and as compared to the piezoelectric actuator 3 in the embodiment (see FIG. 5), the amount of deformation of the vibration plate 30, when the piezoelectric layer 31 in a drive area is contracted, increases. The result of the structure analysis by the finite element method (FEM) in the fourth modified embodiment is shown in Table 2. In this structure analysis, analysis conditions such as the length B of the pressure chamber 14 in the transverse direction, the thickness TV of the vibration plate 30, the thickness Tp of the piezoelectric layer 31D, and the drive voltage are same as the analysis condition for the structure analysis by the finite element method (FEM) in the above-described embodiment.

TABLE 2

| | L1 (μm) | L2 (μm) | Maximum displacement amount (nm) |
|---|---|---|---|
| Model 5 | 92 | 0 | 138 |
| Model 6 | 92 | 30 | 175 |
| Model 7 | 122 | 0 | 154 |
| Model 8 | 122 | 30 | 192 |

From Table 2, it is appreciated that in models (model 6 and model 8) in which the individual electrode 32 is extended up to the area outside of the pressure chamber 14, the maximum displacement amount of the vibration plate 30 are respectively about 1.25 times greater than in models of L2=0 (model 5 and model 7) in which the length L1 of the individual electrode 32 in an area overlapping with the pressure chamber 14 is the same in that of models 6 and 8 but the individual electrode 32 is formed only on the inner side of the pressure chamber 14. Accordingly, it is appreciated that also in the fourth modified embodiment, when the individual electrode 32 is formed up to the area outside of the pressure chamber 14, the amount of deformation of the vibration plate 30 is increased as compared with a case in which the individual electrode 32 is not extended up to the area outside of the pressure chamber 14.

Fifth Modified Embodiment

Figure 12:
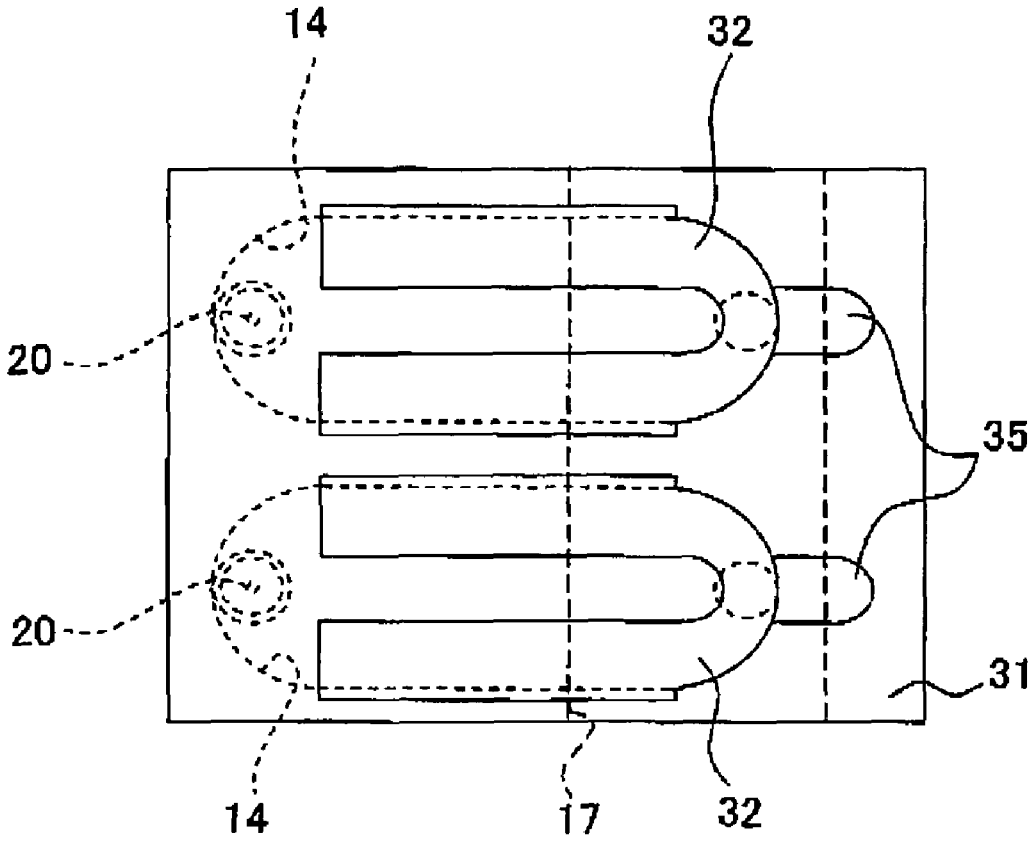
FIG. 12 is a partially enlarged view of a fifth modified embodiment corresponding to FIG. 3.

As in the above-described embodiment, the individual electrode 32 is not necessarily required to be formed in the form of a ring surrounding the central portion of the pressure chamber 14. For example, as shown in FIG. 12, an individual electrode 32E may be such that the individual electrode 32E does not completely surround the central portion of the pressure chamber 14. Furthermore, the individual electrode 32E may be formed at least in an area overlapping with an edge portion on both sides while sandwiching the central portion of the pressure chamber 14. In an example shown in FIG. 12, the individual electrode 32 is extended up to the outside of the pressure chamber 14 only in a direction intersecting (orthogonal to) the longitudinal direction of the pressure chamber 14. In particular, since the amount of deformation of the vibration plate 30 is greater in the direction intersecting (orthogonal to) the longitudinal direction of the pressure chamber 14, the amount of deformation of the vibration plate 30 can be effectively increased by extending the individual electrode 32, in the direction intersecting (orthogonal to) the longitudinal direction of the pressure chamber, up to the outside of the pressure chamber 14. Therefore, as in the fifth modified embodiment, the individual electrode 32 may be extended up to the outside of the pressure chamber 14 only in the direction intersecting (orthogonal to) the longitudinal direction of the pressure chamber 14. An extended portion of the individual electrode 32 may be seen to be formed symmetrically with respect to the central axis of the pressure chamber 14 parallel to the longitudinal direction of the pressure chamber 14.

Figure 13A:
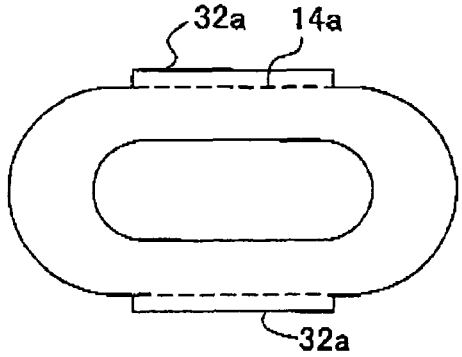
FIG. 13A is a schematic diagram showing an extended portion of an elliptical pressure chamber and an individual electrode to which the present invention is applied.
Figure 13B:
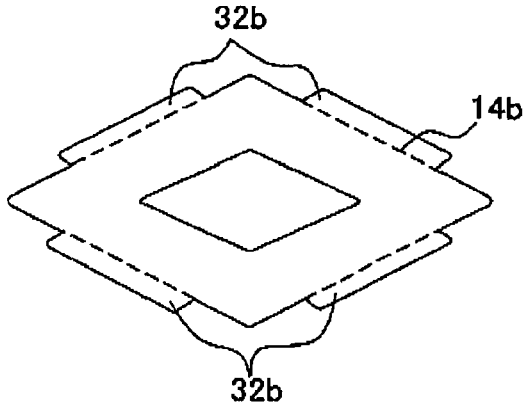
FIG. 13B is a schematic diagram showing an extended portion of a rhombus shaped pressure chamber and an individual electrode to which the present invention is applied.
Figure 13C:
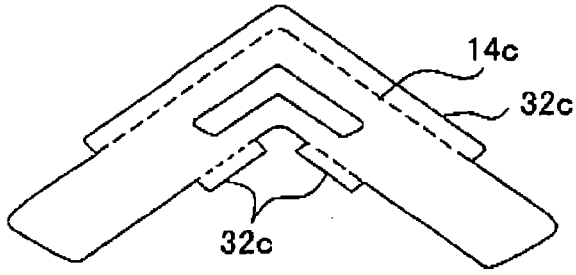
FIG. 13C is a schematic diagram showing an extended portion of a boomerang shaped pressure chamber and an individual electrode to which the present invention is applied.
Figure 13D:
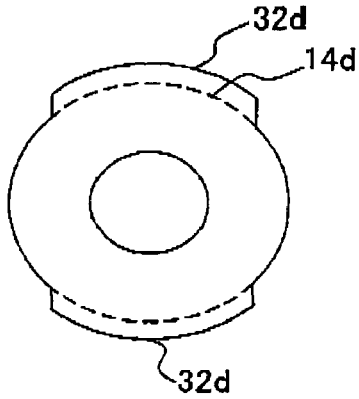
FIG. 13D is a schematic diagram showing an extended portion of a circular shaped pressure chamber and an individual electrode to which the present invention is applied.

The shape of the pressure chamber is not limited to a substantially elliptical shape in the above-described embodiment, and the pressure chamber may be formed in other shape such as a circular shape, rhombus shape, and a rectangular shape. As shown in FIG. 12, in a case where the pressure chamber 14 has a shape which is long in one direction, the length (width) of the individual electrode in the transverse or width direction (vertical direction in FIG. 12) has a substantial effect on the amount of deformation of the vibration plate 30 as described earlier. Therefore, it is desirable that the individual electrode is formed at least in an area overlapping with two edge portions extended in the longitudinal direction (vertical direction in FIG. 12) of the pressure chamber 14. This will be explained specifically by using FIGS. 13A to 13D. FIG. 13A shows an elliptical pressure chamber 14*a* as shown in FIG. 12 and the individual electrode has extended sections (protrusions) 32*a* each extending up to the outside of the pressure chamber 14*a* in a direction orthogonal to the longitudinal direction of the pressure chamber 14*a*. FIG. 13B shows a rhombus shaped pressure chamber 14*b* and the individual electrode has four extended sections (protrusions) 32*b* on four sides of the rhombus respectively, each extending up to the outside of the pressure chamber 14*b* in a direction intersecting the longitudinal direction of the pressure chamber 14*b*. FIG. 13*c* shows a boomerang shaped pressure chamber 14*c* and the individual electrode has extended sections (protrusions) 32*c* on a longer side and shorter sides of the boomerang shape respectively, each extending up to the outside of the pressure chamber 14*c* in a direction intersecting the longitudinal direction of the pressure chamber 14*c*. FIG. 13D shows a circular shaped pressure chamber 14*d* and the individual electrode has a pair of extended sections (protrusions) 32*d* facing each other, each extending up to the outside of the pressure chamber 14*d* in the diametrical direction of the pressure chamber 14*d*. In other words, when the pressure chamber has no longitudinal direction, the individual electrode may have a pair of extended sections (protrusions) facing each other, extending up to the outside of the pressure chamber, facing at each other at least in one direction The embodiment and the modified embodiments described above are examples in which the present invention is applied to an ink-jet head which transports ink. However, the liquid transporting apparatus to which the present invention is applicable is not limited to the ink-jet head. The present invention is also applicable to a liquid transporting apparatus transporting a liquid other than ink such as a liquid transporting apparatus which transports a liquid such as a medicinal solution or a biochemical solution inside a micro total-analyzing system (μTAS), a liquid transporting apparatus transporting a liquid such as a solvent or a chemical solution inside a micro chemical system, for example, a medical equipment transporting blood or a specific component thereof.

What is claimed is:

1. A liquid transporting apparatus comprising:

a channel unit having a plurality of pressure chambers arranged along a plane; and a piezoelectric actuator which applies a pressure to a liquid in the pressure chambers by changing a volume of the pressure chambers, wherein the piezoelectric actuator includes:

a vibration plate which covers the pressure chambers;

a piezoelectric layer which is arranged on a side of the vibration plate opposite to the pressure chambers and which has a plurality of portions each overlapping with one of the pressure chambers, the portions being connected with each other;

a plurality of individual electrodes each of which is arranged in a first area of one surface of the piezoelectric layer, the first area overlapping with an edge portion of each of the pressure chambers as viewed from a direction orthogonal to the plane, the edge portion being a second area other than a central portion of each of the pressure chambers; and a common electrode which is arranged on the other surface of the piezoelectric layer, and wherein each of the individual electrodes, the piezoelectric layer, and the common electrode are extended up to a third area outside of one of the pressure chambers, as viewed from the direction orthogonal to the plane, the common electrode and each of the individual electrodes face with each other to sandwich the piezoelectric layer in the third area, and a length of each of the individual electrodes in the third area outside of one of the pressure chambers is not less than a thickness of a portion of the piezoelectric layer sandwiched by the common electrode and one of the individual electrodes.

2. The liquid transporting apparatus according to claim 1, wherein the channel unit has, in a surface joined to the vibration plate, the plurality of pressure chambers having openings on a side of the vibration plate, and column portions which are positioned between the plurality of pressure chambers, define the respective openings and support the vibration plate, and a portion of each of the individual electrodes extended up to the third area outside of one of the pressure chambers overlaps with the column portions as viewed from the direction orthogonal to the plane.

3. The liquid transporting apparatus according to claim 1, wherein one of the individual electrodes, as viewed from the direction orthogonal to the plane, is extended up to a substantially intermediate position between a pressure chamber included in the pressure chambers and corresponding to the individual electrode and other pressure chamber adjacent to the pressure chamber corresponding to the individual electrode.

4. The liquid transporting apparatus according to claim 1, wherein the vibration plate is formed of a metallic material and functions also as the common electrode.

5. The liquid transporting apparatus according to claim 1, wherein:

the vibration plate is insulative at least on a surface thereof on the side opposite to the pressure chambers; and the common electrode is provided on the surface of the vibration plate on the side opposite to the pressure chambers.

6. The liquid transporting apparatus according to claim 1, wherein:

the vibration plate is insulative at least on a surface thereof on the side opposite to the pressure chambers; and the individual electrodes are formed on the surface of the vibration plate on the side opposite to the pressure chambers.

7. The liquid transporting apparatus according to claim 1, wherein the piezoelectric layer is formed to cover entirely the plurality of pressure chambers.

8. The liquid transporting apparatus according to claim 1, wherein the piezoelectric layer, as viewed from the direction orthogonal to the plane, is formed in an area other than the second area overlapping with the central portion of each of the pressure chambers.

9. The liquid transporting apparatus according to claim 1, wherein a length of each of the individual electrodes in the area outside of one of the pressure chambers is not less than a thickness of the piezoelectric layer.

10. The liquid transporting apparatus according to claim 1, wherein each of the individual electrodes, as viewed from the direction orthogonal to the plane, is extended up to the third area outside of one of the pressure chambers, in a direction intersecting a longitudinal direction of one of the pressure chambers.

11. The liquid transporting apparatus according to claim 1, wherein a portion of each of the individual electrodes which is extended up to the third area outside of one of the pressure chamber is formed symmetrically with respect to a central axis of one of the pressure chambers, the central axis being parallel to a longitudinal direction of one of the pressure chambers.

12. The liquid transporting apparatus according to claim 1, wherein each of the pressure chambers is elliptical in shape and each of the individual electrodes, as viewed from the direction orthogonal to the plane, is extended up to the third area outside of one of the pressure chambers, in a short axis direction of the ellipse.

13. The liquid transporting apparatus according to claim 1, wherein each of the pressure chambers is elliptical in shape and each of the individual electrodes, as viewed from the direction orthogonal to the plane, is extended up to the third area outside of one of the pressure chambers, in a long axis direction and a short axis direction of the ellipse.

14. The liquid transporting apparatus according to claim 1, wherein a portion of each of the individual electrodes which is extended up to the third area outside of one of the pressure chambers is formed along an entire circumference of one of the pressure chambers.

15. The liquid transporting apparatus according to claim 1, wherein once the piezoelectric actuator increases the volume of the pressure chambers to draw the liquid into the pressure chambers, then the piezoelectric actuator decreases the volume of the pressure chambers to apply a substantial amount of pressure to the liquid.

16. The liquid transporting apparatus according to claim 1, which is an ink-jet printer.

* * * * *